United States Patent [19]

Pierson et al.

[11] 4,231,491

[45] Nov. 4, 1980

[54] BUNDLE SUPPORT FOR COMPACT DISPENSING PACKAGE

[75] Inventors: Roger P. Pierson, Cincinnati, Ohio; Lawrence V. Mastalish; Daniel J. Zollar, both of Green Bay, Wis.

[73] Assignee: The Procter & Gamble Company, Cincinnati, Ohio

[21] Appl. No.: 958,085

[22] Filed: Nov. 6, 1978

Related U.S. Application Data

[63] Continuation of Ser. No. 798,960, May 20, 1977, abandoned.

[51] Int. Cl.[3] ..... A47K 10/42; B65H 1/00

[52] U.S. Cl. ..... 221/48; 221/63

[58] Field of Search ..... 221/45–63

[56] References Cited

U.S. PATENT DOCUMENTS

| | | | |
|---|---|---|---|
| 1,657,942 | 1/1928 | Spaldo | 221/47 X |
| 2,287,420 | 6/1942 | Edmonston | 221/63 |
| 2,598,050 | 5/1952 | Guyer | 221/52 X |
| 2,761,584 | 9/1956 | Johnson et al. | 221/63 |
| 3,881,623 | 5/1975 | Early et al. | 221/50 |
| 3,942,682 | 3/1976 | McKay | 221/58 |

*Primary Examiner*—F. J. Bartuska

*Attorney, Agent, or Firm*—John M. Pollaro; Fredrick H. Braun; Richard C. Witte

[57] ABSTRACT

A compact dispensing package for sheet-like products having an improved stack support member with outwardly projecting protuberences. The stack support member is formed from a cardboard blank having essentially the same unfolded length as the sheet-like product contained in the dispensing package, but having a folded length greater than the sheet-like product. The increased length provides better stability for the bundle of sheet-like product during shipping and storage of the compact dispensing package.

3 Claims, 3 Drawing Figures

BUNDLE SUPPORT FOR COMPACT DISPENSING PACKAGE

This is a continuation of application Ser. No. 798,960, filed May 20, 1977, now abandoned.

BACKGROUND OF THE INVENTION

This invention generally relates to compact dispensing packages for sheet-like products. In particular, this invention relates to compact dispensing packages having a discrete support member. Still more particularly, this invention relates to compact dispensing packages having an inverted Y-shaped support member.

In compact dispensing packages, the sheet-like products are folded into a bundle which may be supported, as taught in U.S. Pat. No. 3,881,632 issued to Allen D. Early et al. on May 6, 1975, or unsupported, as taught in U.S. Pat. No. 3,369,700 issued to Howard N. Nelson on Feb. 20, 1968. The bundles are generally formed into the shape of an inverted U although other configurations are known and used by those skilled in the art.

Various methods and devices for supporting the bundle are also known in the art. U.S. Pat. No. 1,657,942 issued to Louis C. Spaldo on Jan. 31, 1928 and U.S. Pat. No. 3,456,843 issued to Thomas H. Planner on July 22, 1969, each teach a tissue bundle supported by the outer wall of the carton which is formed into an upwardly projecting partition. U.S. Pat. No. 3,209,941 issued to Kenneth V. Krake on Oct. 5, 1965 teaches an inverted U-shaped tissue bundle also supported by an upwardly projecting partition formed from the outer wall of the carton. Krake, however, further teaches a separate insert placed atop the partition to maintain the stability of the carton. Further, U.S. Pat. No. 3,243,079 issued to Forrest R. Rettmer teaches a V folded bundle supported by a discrete insert positioned within the carton.

During the manufacture of a supported bundle, the individual sheets of sheet-like product are interleaved and stacked and the blank from which the unfolded support member is formed is placed atop the stack prior to being folded and placed into the carton. To prevent shifting and to keep the sheet-like product essentially centered with respect to the support member the blank is substantially coextensive with the sheet-like product. Thus, the length of the blank can be neither substantially longer nor shorter than the length of the sheet-like product.

After being folded and inserted into the package the bundle is held in dispensing position by the support member. If the length of the support member is too short relative to the diagonal dimension of the package, however, the bundle will not be adequately supported and will be susceptible to displacement during transit or rough handling. The length of the support member is fixed by the length of the tissue and the diagonal dimension of the package is fixed by the packaging machine, and neither parameter may be changed without unfavorable consequences. Specifically, changing the length of the support member could result in the sheet-like product shifting to an off-center position relative to the support member thus preventing the sheets from being dispensed properly and changing the diagonal dimension of the package could increase manufacturing costs by causing packing machines to be redesigned.

The prior art stack support members lack the aspects of the present invention whereby an outwardly projecting protuberence increases the length of the folded insert thereby providing improved stability of the sheet material bundle.

Accordingly, it is an object of the present invention to provide a compact dispensing package having a support member with improved stability.

An additional object of the present invention is to provide a bundle support member having outwardly projecting protuberences.

A further object of the present invention is to provide a bundle support member having a length greater than the length of the blank from which it is formed.

SUMMARY OF THE INVENTION

In a compact dispensing package for sheet-like materials, the individual sheets are generally interleaved, U-folded, and supported by a bundle support member. According to the present invention, the bundle support member is provided with outwardly projecting protuberences thereby increasing the length of the support member without increasing the length of the blank from which the support member is formed.

In one preferred embodiment of the invention, a plurality of semi-circles are cut in the blank such that the diameter of the semi-circle and the medial fold line of the blank are coincident. When the blank is folded along the medial fold line the semi-circles project outwardly from the upper edge thus formed in the bundle support member thereby providing a bundle support member having a longer length than the blank from which it was formed.

The longer the length of the bundle support member the greater the stability of the bundle. A bundle support member having the protuberances of the present invention, therefore, will provide more resistance to bundle shifting than a bundle support member formed from the same length blank but not having the protuberance.

DESCRIPTION OF THE PREFERRED EMBODIMENT

Referring now to the figures, there is shown a preferred embodiment of the present invention as it would be used in a compact dispensing package for facial tissues. It should be understood, however, that the present invention is broadly applicable to the art of dispensing packages for sheet-like products. As used herein the term "sheet-like products" refers to products which are thin relative to their breadth and length and which are substantially flaccid and flexible. Further, as used herein, the term "compact dispensing package" refers to packages intended to contain a plurality of interleaved sheets of a sheet-like product in a folded configuration such that pop up dispensing of the successive sheets is facilitated.

Figure 1:
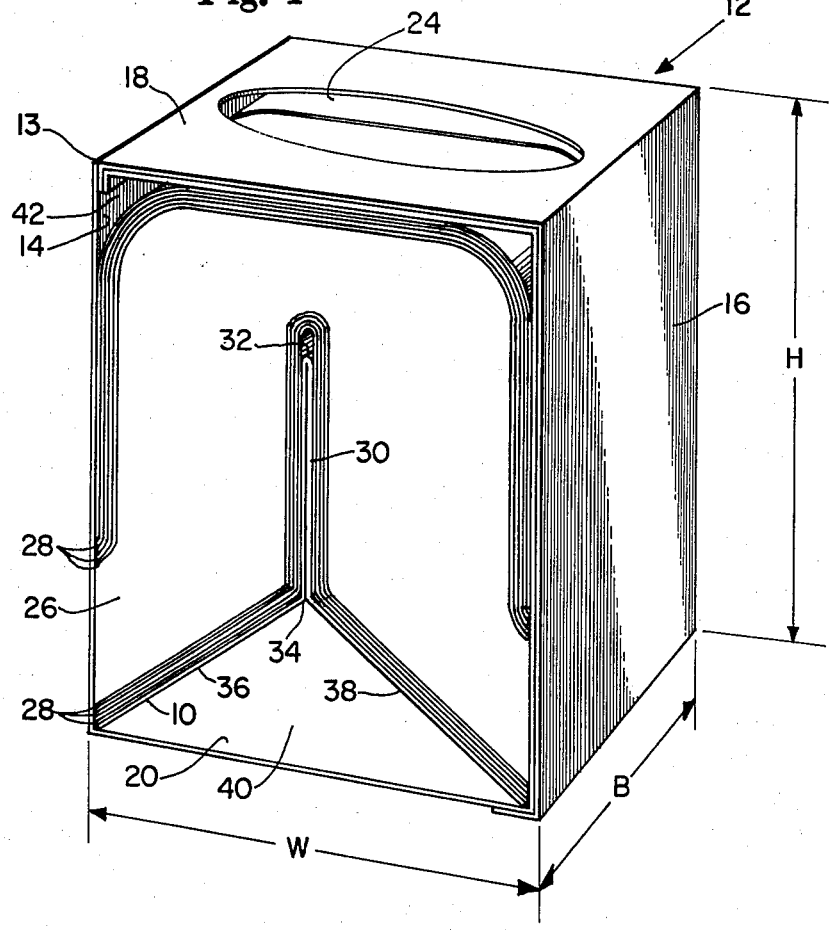
FIG. 1 is a partially cut away perspective view of a compact dispensing package embodying the present invention.

As best seen in FIG. 1, a preferred compact dispensing package 12 basically basically comprises a bundle support member 10, a carton 13, and a bundle 26 of sheets 28 of a sheet-like product. Carton 13 is preferably formed from cardboard into a form sustaining, somewhat cubical shape having a front wall 14, a back wall 16, side walls (not shown), top wall 18, and bottom wall 20. Top wall 18 has an elongated aperture 24 centrally disposed therein. A suitable compact dispensing package is described in U.S. Pat. No. 3,881,632 issued to Allen D. Early on May 6, 1975 which patent is herein incorporated by reference.

Carton 13 contains a plurality of sheets 28 of a sheet-like product, such as facial tissues, which are folded to form bundle 26. Bundle 26 is preferably folded into a U-shape although other configurations such as a V-shape may also be used. Sheets 28 of bundle 26 are interleaved to promote pop-up dispensing in any manner well known in the prior art. A suitable interleaving fold arrangement is described in the aforementioned U.S. Pat. No. 3,881,632.

Bundle 26 is held in dispensing position in carton 13 by bundle support member 10. Dispensing position is that position which permits uppermost sheet 28 to be pulled through aperture 24 successively in a pop-up fashion. Bundle support member 10 has a stem 30 with an upper edge 32 and a lower edge 34 hingedly affixed to arms 36 and 38.

In the preferred embodiment of FIG. 1, support member 10 assumes an inverted Y-shaped configuration when inserted into carton 13 with upper edge 32 of stem 30 projecting toward top wall 18 and essentially centered about apeture 24. In this position, carton 13 is divided into a triangular cross-section tubular void 40 disposed between arms 36 and 38 and bottom wall 20 and a bundle accomodating space 42 disposed between member 10 and front, back, and top walls 14, 16, and 18 respectively of carton 13.

Figure 2:
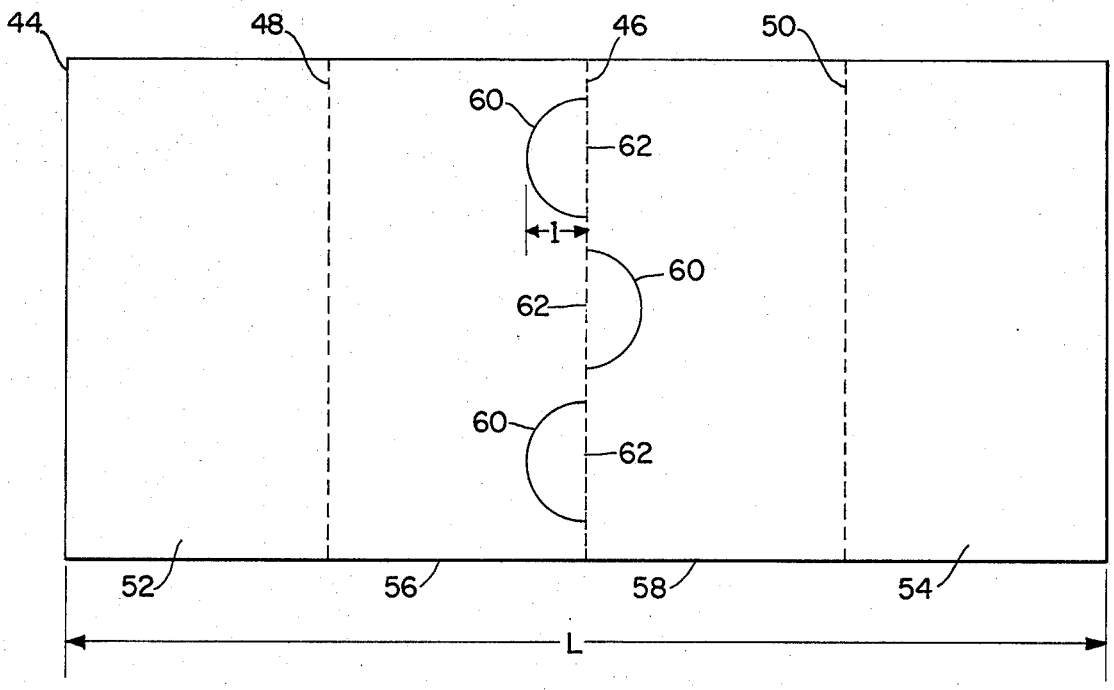
FIG. 2 is a plan view of a carton-board blank prior to being folded to form a bundle support member.

FIG. 2 is a plan view of a rectangular carton board blank 44 having a length "L" from which member 10 is formed. Blank 44 is provided with a medial fold line 46 and two intermediate fold lines 48 and 50. The fold lines 46, 48 and 50 divide blank 44 into four rectangular areas which are hereby designated arm portions 52 and 54 and stem portions 56 and 58. When blank 44 is folded to form support member 10 having an inverted Y-shaped configuration (shown in FIG. 1) it is folded in such a manner that it has substantially no residual resilience so that it will not pinch bundle 26 of sheets 28 between the upper edge 32 of support member 10 and top wall 18 of carton 13. Otherwise, if the support member 10 has substantial resilience acting outwardly on bundle 26, dispensing, particularly intitial dispensing, would be difficult and perhaps result in tearing one or more sheets 28. Furthermore, if a plurality of closely spaced medial fold lines are provided, the positioning of each blank with respect to folding devices becomes less critical.

At least one and preferably a plurality of tabs 60 having an inward side 62 are cut in stem portions 56 and 58 such that inward side 62 is uncut and essentially coincident with medial fold line 46. Tabs 60 may be cut in either stem portion 56 or 58 and are preferably cut alternatively in both stem portions 56 and 58. In the preferred embodiment tabs 60 are semicircular with inward side 62 being the diameter. Other configurations for tabs 60 may be used, such as parabolic or hyperbolic shapes, but it is preferable that tabs 60 have no sharp corners in order to prevent binding between tabs 60 and bundle 26. The length "l" of tabs 60 is measured perpendicularly from medial fold line 46 to the farthest point of tab 60.

Sheets 28 are interleaved and stacked with blank 44 being placed on top of the stack prior to being folded into bundle 26 and inserted into carton 13. To ensure that sheets 28 are centered relative to blank 44 (i.e., the centerline of sheet 28 and medial fold line 46 of blank 44 are coincident) the external dimensions of blank 44 are substantially coextensive with the external dimensions of sheets 28. Thus, the length L of blank 44 is substantially equal to the length of sheets 28.

Figure 3:
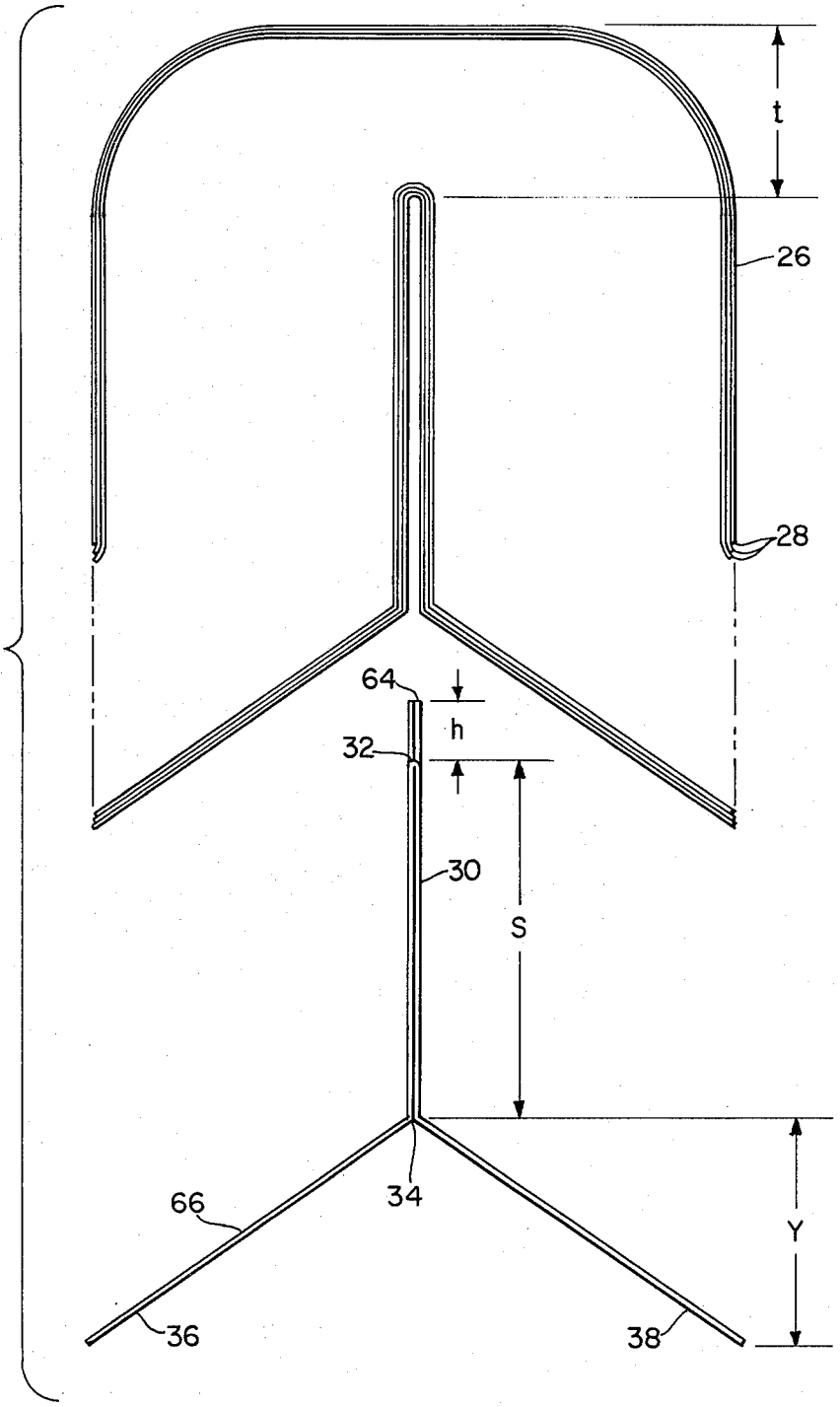
FIG. 3 is an exploded side view of the bundle support member of the present invention and a U-shaped bundle of sheet-like product.

Blank 44 is folded to form bundle support member 10 as shown in FIG. 3 in the following manner. Blank 44 is folded along medial fold line 46 with stem portions 56 and 58 being placed in face-to-face relationship thereby forming stem 30 and upper edge 32. Arms 36 and 38 and lower edge 34 are formed by folding blank 44 along intermediate fold lines 48 and 50. When blank 44 is folded along medial fold line 46, tabs 60 will project outward from upper edge 32 forming outwardly projecting protuberance 64. The height "h" which protuberence 64 extends beyond upper edge 32 is determined by and is equal to the length "l" of tab 60. The length of member 10 is measured along upper surface 66 and is longer than length "L" of blank 44 by twice height "h". The greater the height h the greater the stability and resistance to shifting of bundle 26. The maximum height "h" which is permissible is determined in accordance with the following formula:

$$h < H - t - S - Y$$

where:

H = height of carton 13 (See FIG. 1)

S = length of stem 30

Y = perpendicular distance between lower edge 34 and bottom wall 20.

A representative example of the preferred embodiment of compact dispensing package 12 comprises a carton 13 having a height H, width W and breadth B of 5.5 inches, (14 cm), 4.375 inches (11.2 cm), and 4.375 inches (11.2 cm) respectively, a bundle 26 comprising about 125 two-ply sheets of facial tissue which bundle has an uncompressed thickness t of approximately 1.75 inches (4.45 cm), the sheets 28 each being approximately 9.6 inches (24.5 cm) long by 4.12 inches (10.5 cm) wide being U-folded about the trasverse center line and being interleaved with each other to promote pop-up dispensing. In this example, member 10 is formed from blank 44 having a length L of 9.6 inches (24.5 cm) a width of 4.25 inches (10.8 cm) and is provided with fold lines 46, 48, and 50 to divide blank 44 into arm portions 52 and 54 having lengths of about 2.375 inches (6 cm) each and stem portions 56 and 58 having lengths of about 2.437 inches (6.2 cm) each. Three semicircular tabs 60 are cut in blank 44 such that two tabs 60 are cut in stem portion 56 and one tab 60 is cut in stem portion 58. The diameter of tabs 60 is approximately 0.50 inches (1.2 cm) and is coincident with medial fold line 46. Thus, height h of protuberances 64 is 0.25 inches (0.6 cm).

In this representative example of the present invention, carton 13, member 10, and bundle 26 are so configured that the bundle substantially fills the bundle accomodating space 42 without binding sheets 28 of bundle 26. Bundle 26 is supported so that the first sheet can be grasped and withdrawn, by extending a thumb and forefinger through aperture 24.

The present invention may, of course, be practiced other than as specifically described as the preferred embodiment. For example member 10 may assume an inverted T-shape when inserted into carton 13. Obviously, there are many other variations and modifications of the present invention which may be effected in the preferred embodiment without departing from the scope and spirit of the invention.

What is claimed:

1. An improved compact dispensing package for sheetlike materials comprising:

a folded bundle of sheets of flexible material;

a carton for containing said folded bundle of sheets of flexible material; said carton having a top wall with a dispensing aperture therein; and a support member for maintaining said folded bundle in dispensing position within said carton; said support member being folded from a blank having first and second stem portions and having a stem projecting toward said top wall; said stem comprising an upper edge and said first and second stem portions being joined at said upper edge and having at least one outwardly projecting protuberance integral with said support member and essentially coincident with said upper edge of said stem; said stem having an outer surface which contacts and supports said folded bundle; said protuberance forming an extension of said stem whereby the length of said outer surface of said stem is greater than the sum of the lengths of said first and second stem portions.

2. The improved compact dispensing package of claim 1, wherein said folded support member has two arms hingedly affixed to said stem.

3. The improved compact dispensing package of claim 2 wherein said folded support member is Y-shaped.

* * * * *